US005361479A

United States Patent [19]

Sorem

[11] Patent Number: 5,361,479

[45] Date of Patent: Nov. 8, 1994

[54] METHOD OF ASSEMBLY FOR INFLATABLE PACKER

[75] Inventor: Robert M. Sorem, Tulsa, Okla.

[73] Assignee: Dowell Schlumberger Incorporated, Sugar Land, Tex.

[21] Appl. No.: 981,714

[22] Filed: Nov. 25, 1992

[51] Int. Cl.[5] ..... B23P 19/04

[52] U.S. Cl. ..... 29/454; 29/527.1; 166/187

[58] Field of Search ..... 29/454, 527, 458.1; 166/187; 277/34, 34.3, 34.6

[56] References Cited

U.S. PATENT DOCUMENTS

| | | | |
|---|---|---|---|
| 3,837,947 | 9/1974 | Malone | 156/69 |
| 4,832,120 | 5/1989 | Coronado | 166/187 |
| 4,951,747 | 8/1990 | Coronado | 166/187 |
| 5,143,154 | 9/1992 | Mody et al. | 166/187 |
| 5,195,583 | 3/1993 | Toon et al. | 29/454 X |

*Primary Examiner*—Timothy V. Eley
*Attorney, Agent, or Firm*—Stephen A. Littlefield

[57] ABSTRACT

The strength of slats attached to an inflatable packer assembly by welding is increased by forming the slats of an age-hardening materials, welding the slats to the inflatable packer assembly in an annealed condition followed by age-hardening of the welded slats. A slat structure having much greater strength than welded cold-worked material is realized.

2 Claims, 2 Drawing Sheets

METHOD OF ASSEMBLY FOR INFLATABLE PACKER

This invention relates to the art of production of subterranean fluid through a wellbore and more particularly, to an inflatable packer or bridge plug useful in temporarily isolating portions of a wellbore.

BACKGROUND OF THE INVENTION

Inflatable packers or bridge plugs have long been used in wellbore operations. An inflatable packer typically comprises a tubular base and a surrounding, inflatable elastomeric bladder or sleeve. Fluid passages within the tubular body allow fluids to contact the inflatable bladder and expand the bladder radially outwardly to effect sealing engagement with a borehole or well casing.

Since the elastomeric bladder is subjected to both expansion pressure and abrasion or cutting forces, it has been common to surround the exterior surface of the bladder with a plurality of peripherally overlapping, resilient reinforcing slats or ribs. There is generally sufficient overlap of such slats that upon expansion of the inflatable bladder, the slats remain as a surrounding armor protecting the bladder from abrasion and cuts while also preventing extrusion of the bladder elastomer between the slats in a localized area. The slats are commonly welded to a portion of the assembly to retain their desired position and orientation. U.S. Pat. No. 5,143,154 describes one frozen of slat weldment.

Because the slats cannot effect the sealing of the packer against a wellbore or casing, at least some portions of the reinforcing slats are surrounded by and may be bonded to an outer annular elastomeric cover or packing element which, upon expansion of the inflatable packer, comes into pressure sealing engagement with the wellbore or casing.

The outer sealing cover generally comprises either a single or a plurality of annular circumferential elastomeric pieces located on the outer surface of the reinforcing slats. When a single elastomeric piece is employed it may cover only a portion of the longitudinal length of the slats or, alternatively, it may cover the entire outer surface of the slats. Such single piece covers generally have a uniform thickness along their length, the thickness generally being substantial. Such arrangements are described in U.S. Pat. No. 3,837,947, 4,832,120 and 5,143,154.

Slat reinforced inflatable packers are typically constructed of high strength, cold-worked slats welded to an end connector. The resulting heat affected zone of the slats has significantly lower strength (as much as 70% lower strength) than the unwelded portions of the slats. Such a condition substantially reduces the overall strength of the packer.

SURVEY OF THE INVENTION

The present invention overcomes the reduction in packer strength as a result of welding high strength cold-worked steel slats.

In accordance with the invention, the method of assembly of an inflatable packer includes the attachment of a plurality of reinforcing slats to an end connector of the packer. The improvement comprises the sequential steps of forming the slats of an age hardening material in annealed condition, welding the slats to the end fitting and age hardening the resultant welded slats and end fitting.

Further in accordance with the invention, the aforementioned age hardening step includes heat treatment of welded slats and end fitting.

BRIEF DESCRIPTION OF THE DRAWINGS

The invention will now be described in greater detail with reference to the accompanying drawings forming a part of the specification and in which.

DETAILED DESCRIPTION OF THE PREFERRED EMBODIMENTS AND THE DRAWINGS

Figure 1:
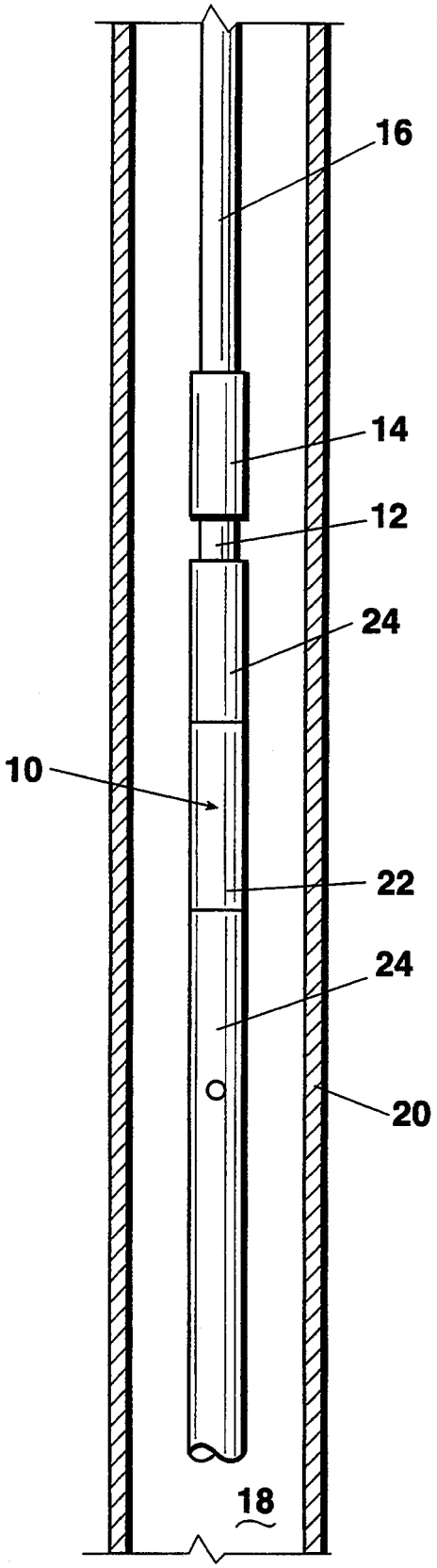
FIG. 1 schematic view of an inflatable packer in use prior to inflation.

Referring now to the drawings, wherein the showings are for the purposes of illustrating the preferred embodiment of the invention only and not for the purposes of limiting same, FIG. 1 schematically illustrates the inflatable packer device in its run-in condition prior to inflation. It will be understood that the inflatable packer may be one packing element of a bridge plug or only a single packer employed to isolate one part of a wellbore from another. The packer element 10 includes a tubular base portion 12 and is interconnected with a coupling member 14 to a tubular string 16 extending to the surface. It will be appreciated that the tubular string 16 can be formed by coupling individual sections of pipe or, in a preferred embodiment of the invention, a continuous length of coiled tubing inserted into the wellbore 18 having a casing 20.

The packer element 10 generally comprises an inflatable portion 22 with at least one and possibly two associated end fittings 24. It will be further understood that the inflatable packer may be associated with one or more downhole tools such as to effect the injection of various fluids into isolated portions of the wellbore 18.

Figure 2:
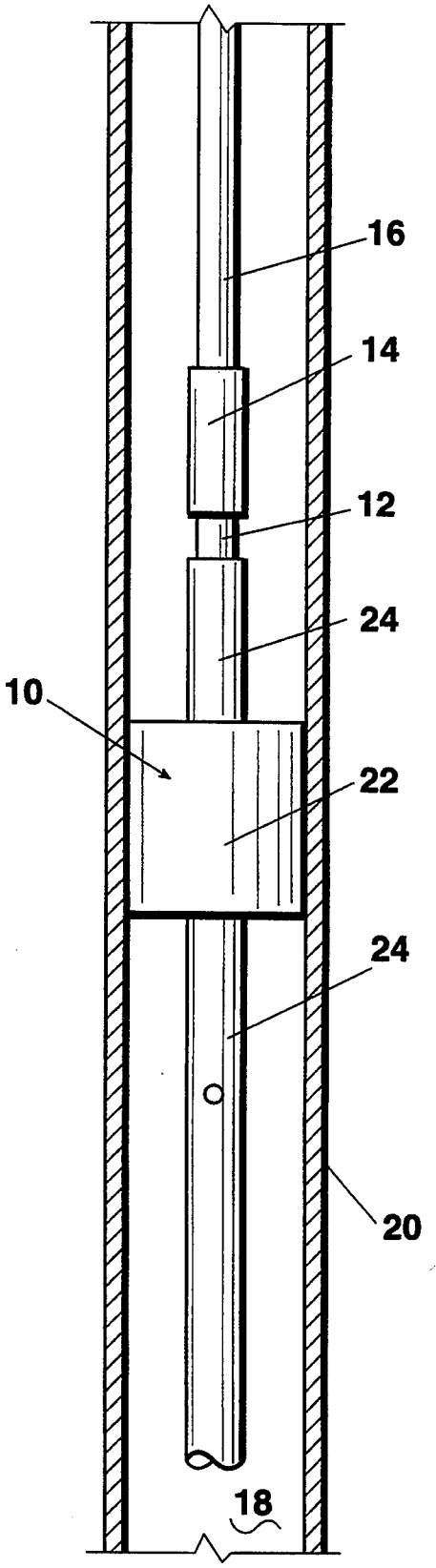
FIG. 2 is a schematic view similar to FIG. 1 showing the inflatable packer in the inflated condition.

At the point desired in the wellbore, the inflatable portion 22 of the packer element 10 is expanded through the application of fluid pressure to the interior of the inflatable portion and expanded outwardly into engagement with the casing 20 (FIG. 2). It will be understood that while the use of the inflatable packer of the present invention is shown in conjunction with a cased borehole, the inflatable packer may also be used in an uncased wellbore under appropriate conditions known to those skilled in the art.

Figure 3:
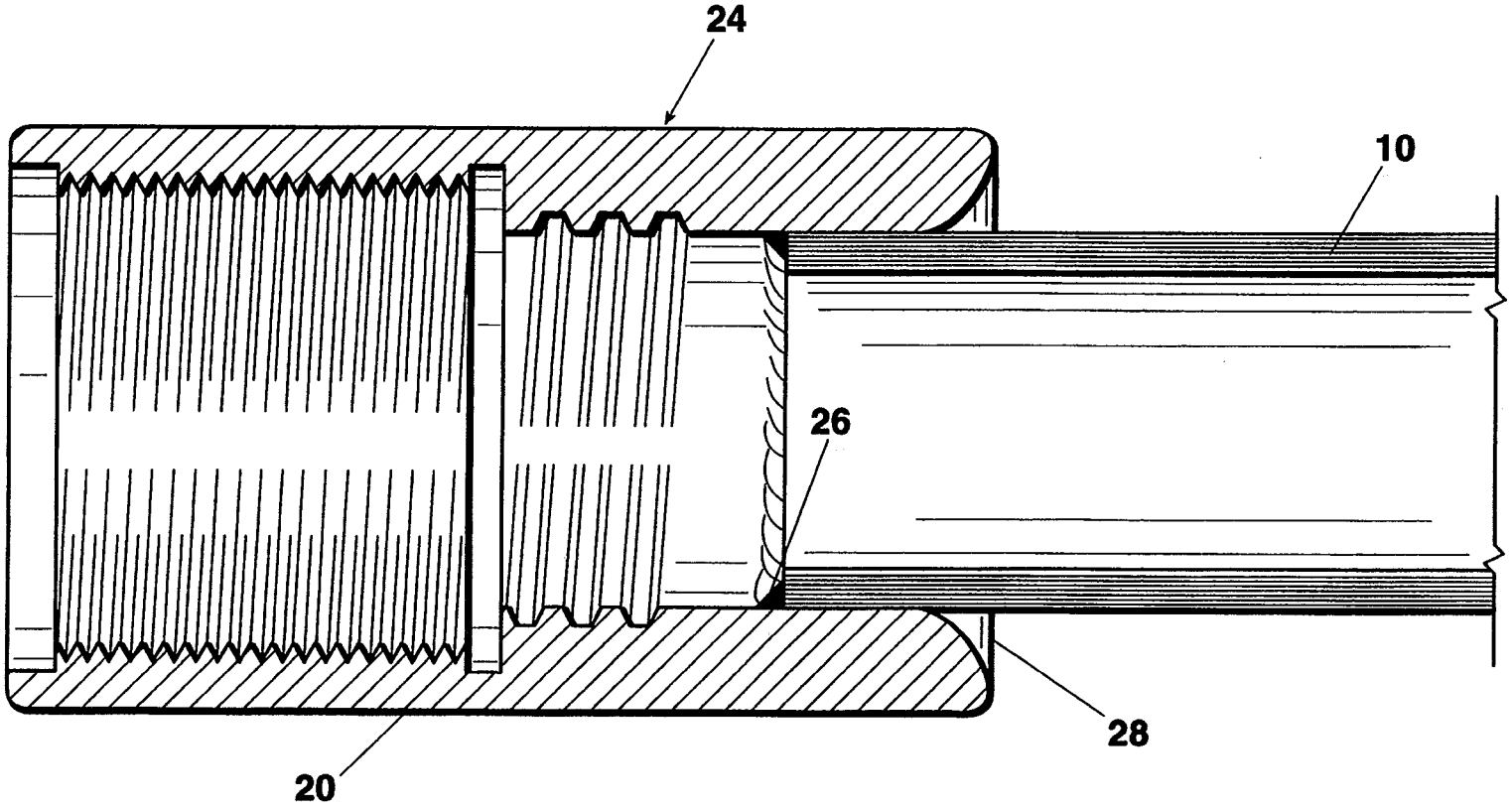
FIG. 3 is a cross-sectional elevation of a portion of the end fitting of an inflatable packer illustrating slat weldment in accordance with the present invention.

As shown in FIG. 3, a plurality of overlapping slats 10 are welded at their end portions to an end fitting 24 with a weld bead 26. While the assembly is shown with the slats 10 welded to an inner cylindrical surface of the end fitting 24, it will be appreciated that other arrangements are possible such as the welding of the slats 10 to the end face 28 of the end fitting 24 or, possibly, the outer surface 30 of the end fitting 24.

Typically the slat material is 301¾ hard stainless steel. The yield strength of cold-worked material is 135 ksi minimum. After welding, the heat affected zone adjacent the welded ends of the slats 10 has the properties of annealed material which has a yield strength of 40 ksi. Thus, the slat in this heat affected area is 70% weaker than the rest of the slat.

In accordance with the invention, the slats 10 are formed of an age-hardening material which is welded in the annealed condition and then aged. Following age-hardening, the slat has full age-hardened strength which is equal to that of cold-worked stainless steel which has not been affected by heat. Additionally, the weld material can easily have a strength greater than that of the slat.

The strength of the slats formed of the age-hardening material can be elevated to an even greater degree by heat treating in accordance with practices familiar to those skilled in the art.

In accordance with the invention, the slats 10 are formed of an age-hardening material which is welded to the end fitting 24 in the annealed condition, The welded assembly is solution annealed at approximately 1700° to 2000° F. for one hour to relieve residual stresses and to form a more uniform microstructure in weld heat affected zone. The annealed assembly is aged to harden the slats 10, end fitting 24 and weld 26. Many age-hardening treatments are possible in accordance with practices familiar to those skilled in the art. One possible two stage age-hardening is to age at 1400° F. for ten hours then furnace cool to 1200° F. and hold for total aging time of twenty hours. It is important to hang the welded assembly during the annealing and aging treatments to prevent distortion of the slats. Following age-hardening, the welded slat assembly has a strength which is equal to, or greater than, that of cold-worked stainless steel which has not been affected by welding.

While the invention has been described in the more limited aspects of the preferred embodiment thereof, other embodiments have been suggested and still others will occur to those skilled in the art upon a reading and understanding of the foregoing specification. It is intended that all such embodiments be included within the scope of this invention as limited only by the appended claims.

Having thus described my invention, I claim:

1. In the method of assembly of an inflatable packer including attachment of a plurality of reinforcing slats to an end fitting of said packer, the improvement which comprises the sequential steps of forming slats of an age-hardening material in annealed condition, welding said slats to said end fitting and age hardening the resultant welded slats and end fitting.

2. The improved method as set forth in claim 1 further including the step of heat treating the welded slats and end fitting.

* * * * *